United States Patent [19]

Yokoyama

[11] 4,316,697

[45] Feb. 23, 1982

[54] FRONT-LOADING HYDRAULIC EXCAVATOR

[75] Inventor: Masao Yokoyama, Komatsu, Japan

[73] Assignee: Kabushiki Kaisha Komatsu Seisakusho, Tokyo, Japan

[21] Appl. No.: 102,366

[22] Filed: Dec. 11, 1979

[30] Foreign Application Priority Data

Dec. 13, 1978 [JP] Japan ..... 53-153059
Dec. 13, 1978 [JP] Japan ..... 53-170362[U]

[51] Int. Cl.[3] ..... E02F 3/28
[52] U.S. Cl. ..... 414/694; 414/707
[58] Field of Search ..... 74/522, 586; 414/694, 414/697, 700, 701, 706, 707, 710, 712, 713, 714

[56] References Cited

U.S. PATENT DOCUMENTS 125,999 4/1872 White ..... 74/586 X
1,156,789 10/1915 Lough ..... 74/586 X
3,259,259 7/1966 Metailler ..... 414/694
3,872,991 3/1975 Pasideris et al. ..... 414/707
3,952,890 4/1976 Armstrong ..... 414/694

*Primary Examiner*—Robert W. Saifer
*Attorney, Agent, or Firm*—Armstrong, Nikaido, Marmelstein & Kubovcik

[57] ABSTRACT

A hydraulic excavator has a bucket actuating and control linkage comprising a boom pivotally connected at one end to a self-propelled vehicle, a stick pivotally connected at one end to the other end of the boom, and a bucket pivotally mounted on the other end of the stick. A pair of hydraulic cylinders for actuating the bucket are pivotally connected to the boom via a pair of bucket attitude control bellcranks, respectively. By adjustment of the angular position of the bucket attitude control bellcranks relative to the boom, as by another pair of hydraulic cylinders, the bucket can be conditioned for a level crowd attitude, crowd-to-carry attitude, or crowd-to-dump attitude.

9 Claims, 4 Drawing Figures

FRONT-LOADING HYDRAULIC EXCAVATOR

BACKGROUND OF THE INVENTION

1. Field of the Invention

This invention pertains to earthmovers, to excavators, and in particular to a fluid- or hydraulic-actuated excavator of the front-loading, level-crowding variety. More particularly the invention concerns improvements in the linkage for the actuation and control of a bucket in such a fluid-actuated excavator.

2. Description of the Prior Art

The implement assembly of a front-loading hydraulic excavator, mounted on a full-revolving carrier of the track or wheel type, normally comprises a boom pivoted at one end on the vehicle, a stick pivotally connected at one end to the outer or front end of the boom, and a front-loading or front-opening bucket pivotally mounted on the other end of the stick. A hydraulic cylinder or cylinders under operator control are provided for operation of each of the boom, the stick, and the bucket.

As is well known, the boom, stick, bucket, and bucket control cylinders of the above implement assembly form in combination a parallelogram-type linkage. The geometry of this linkage permits the bucket to crowd forward parallel to the ground without requiring manipulation of the hoist or bucket angle.

The known parallelogram-type linkage has problems, however, arising from the fact that the joints forming the four corners of the parallelogram are fixed, not displaceable or adjustable with respect to each other. Thus, once the bucket is set for a certain operating attitude or angle, this angle remains substantially unchanged if the stick is pivoted relative to the boom. A change from one bucket attitude to another is possible only through the actuation of the bucket control cylinders.

The operation of a front-loading hydraulic excavator will be relieved of much of his fatigue if the bucket can be set for a desired one of several operating attitudes without manipulation of the bucket control cylinders. It is also desired that the bucket be conditioned for two successive, different attitudes (e.g., a crowd attitude followed by a carry or a dump attitude) at one time.

Another problem with the conventional parallelogram-type linkage is that the angle of the bucket relative to the ground increases as the boom is raised. The consequent spilling of the load over the back of the bucket can be avoided only by manually maintaining the bucket in the proper carry attitude throughout its upward stroke. This also adds to the operator's work and fatigue.

SUMMARY OF THE INVENTION

It is among the objects of this invention to provide a fluid-actuated excavator capable of automatically controlling bucket attitude during crowding operation.

Another object of the invention is to provide a bucket actuating and control linkage equipped to condition the bucket for two successive, different attitudes required in either or both of excavating and loading operations.

A further object of the invention is to provide a fluidactuated excavator including such a linkage whereby the bucket can be automatically maintained in a precise carry attitude during its upward motion, thereby preventing load spillage.

In summary this invention provides a bucket actuating and control linkage comprising a boom pivotally mounted at one end on the rotatable platform of a vehicle, a stick pivotally connected at one end to the other, front end of the boom, and a bucket pivotally connected to the other end of the stick. A bucket attitude control lever is pivotally connected at one end to the boom. To the other end of this bucket attitude control lever is pivotally connected one end of a fluid-actuated bucket control cylinder, which is connected at the other end to operate the bucket. The linkage further comprises means operatively connected between the vehicle platform and the bucket attitute control lever for adjustably varying the angular position of the latter about said one end thereof.

The change in the angular position of the bucket attitude control lever results, of course, in the displacement of its point of pivotal connection to the bucket control cylinder. The bucket can be set for a desired attitude or for two successive, different attitudes by suitably selecting the angular orientation of the bucket attitude control lever.

According to another feature of the invention the means (e.g., a hydraulic cylinder or cylinders) for adjustably varying the angular position of the bucket attitude control lever is connected to the vehicle platform at a point offset forwardly from the position where the boom is mounted thereon. This arrangement permits the bucket to be lifted to a desired dump height without tilting backward and so spilling the load.

The above and other objects, features, and advantages of this invention and the manner of attaining them will become more apparent and understandable from the following description, which is to be read in connection with the accompanying drawings showing some preferred embodiments of the invention.

DESCRIPTION OF THE PREFERRED EMBODIMENTS

Figure 1:
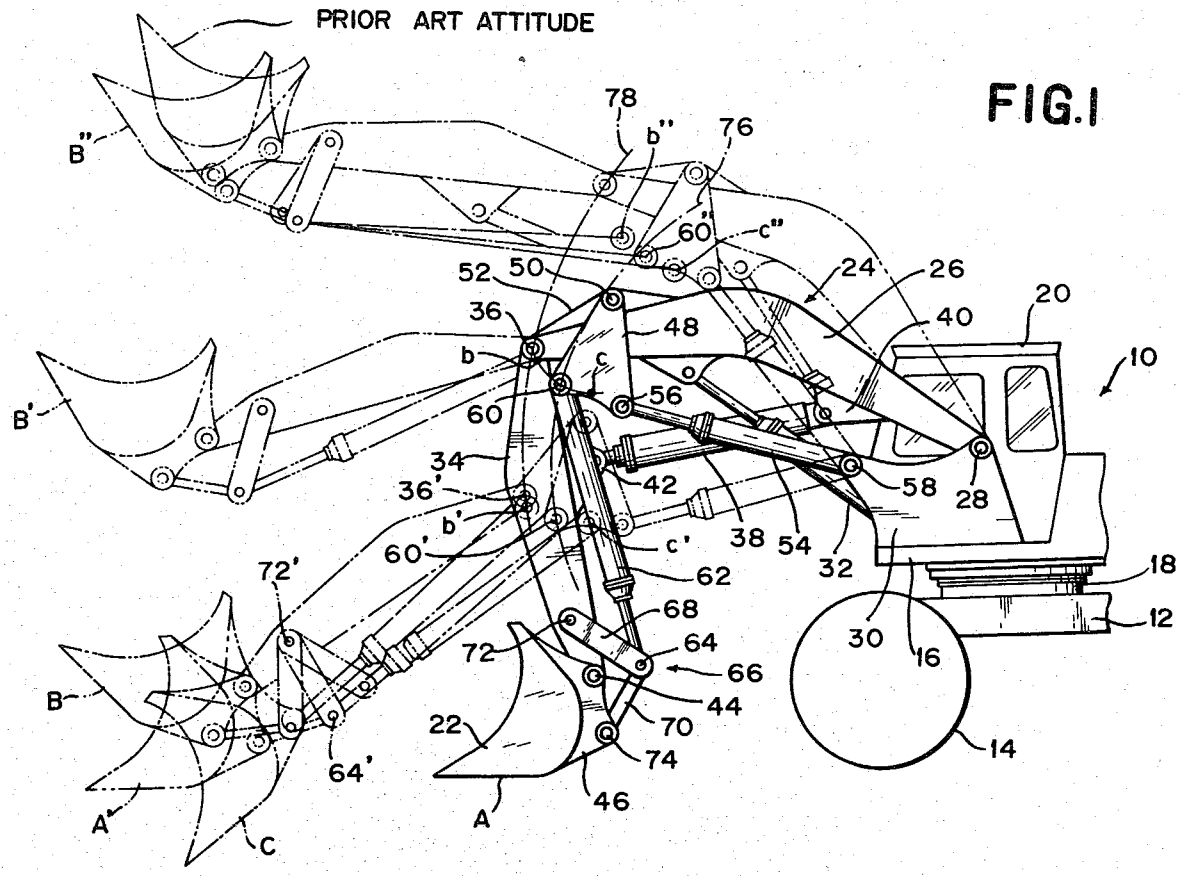
FIG. 1 is a side elevational view of a front-loading hydraulic excavator including the bucket actuating and control linkage of this invention, with the linkage being shown in the fully retracted position by the solid lines and in various other operating positions by the broken lines.

The above drawings illustrate the present invention as adapted specifically for a wheel-mounted, full-revolving, front-loading, level-crowding hydraulic excavator, by way of one application of the invention. With reference first to FIG. 1 the illustrated hydraulic excavator includes a self-propelled, four-wheeled vehicle 10 comprising an undercarriage in the form of a lower frame 12 mounted on wheels 14, and an upper frame or platform 16 rotatably mounted on the lower frame by suitable bearing means 18. An operator's cab 20 is mounted on the platform 16.

Also mounted on the vehicle platform 16 to form a hydraulic excavator is an implement assembly comprising a bucket 22 and a bucket actuating and control linkage 24. This linkage includes a boomerang-shaped boom 26 having one end pivotally connected at 28 to a bracket 30 on the vehicle platform 16 and generally extending forwardly or outwardly from the vehicle 10. A pair of hydraulic hoist or lift cylinders or jacks 32 (one seen) are operatively connected between the platform bracket 30 and the boom 26 for controlling the pivotal up-and-down motion of the boom about the pivot 28.

The bucket actuating linkage 24 further includes a stick 34 having one end pivotally connected at 36 to the front or outer end of the boom 26. Lying between the pair of hoist cylinders 32, a hydraulic crowd cylinder 38 is pivoted at one end on a bracket 40 secured to the boom 26 and at the other end on a bracket 42 secured to the stick 34. The crowd cylinder 38 controls the pivotal motion of the stick 34 about the pivot 36. The stick 34 has its outer or lower end pivotally connected at 44 to a bracket structure 46 on the back of the bucket 22. This bucket is of the front-loading type, opening away from the vehicle 10.

One of the features of this invention resides in a pair of bucket attitude control bellcranks or levers 48 (one seen), hereinafter referred to as the control bellcranks. The pair of control bellcranks 48 are shown as substantially rectangular plates disposed on opposite sides of the boom 26 and each having one of its apexes pivotally connected at 50 to a bracket 52 formed on the boom adjacent its front end.

For adjustably varying the angular position of the control bellcrank pair 48 about the pivot 50, this embodiment employs a pair of hydraulic cylinders 54 (one seen) of the double-acting type. Each bellcrank adjusting cylinder 54 has its rod pivotally connected at 56 to one of the control bellcranks 48, the pivot 56 being located at one of the other two apexes of each bellcrank.

The head ends of the bellcrank adjusting cylinder pair 54 are pivotally connected at 58 to the bracket 30 on the vehicle platform 16. Thus the bellcrank adjusting cylinder pair 54 pivots at 58 with the pivotal motion of the boom 26 about the pivot 28, to cause the corresponding angular displacement of the control bellcrank pair 48 about the pivot 50. In this embodiment the pivot 58 of the bellcrank adjusting cylinder pair 54 lies some distance forwardly of the pivot 28 of the boom 26 on the platform bracket 30.

Each control bellcrank 48 has its remaining one apex pivotally connected at 60 to one of a pair of hydraulic bucket control cylinders 62 extending alongside the stick 34. The rods of the bucket control cylinder pair 62 are operatively connected at 64 to a wrist linkage 66 for operating the bucket 22. The wrist linkage 66 comprises pairs of links 68 and 70 pivotally joined together at the pivot 64 of the bucket control cylinder pair 62. The link pair 68 is further pivotally connected at 72 to the stick 34, whereas the other link pair 70 is pivotally connected at 74 to the bucket bracket structure 46.

Attention is now called to the notional quadrilateral whose corners are at the pivots or joints 36, 60, 64 and 72. Actually comprised of the boom 26, the stick 34, the control bellcrank pair 48, the bucket control cylinder pair 62, and the wrist linkage 66, this imaginary "quadrilateral linkage" plays a vital role in controlling the attitude of the bucket 22. The extension and contraction of the bucket control cylinder pair 62 results in the tilting of the bucket 22 about the pivot 44.

Further the extension and contraction of the bellcrank adjusting cylinder pair 54 results in the corresponding change in the position of the pivot or corner 60 relative to the other three corners 36, 64 and 72 of the quadrilateral configuration. This change in the quadrilateral configuration modifies the attitude of the bucket 22 with the movement of the boom 26 and the stick 34, as will be better understood from the following description of operation.

Operation

The solid lines of FIG. 1 depict the bucket 22 and its actuating linkage 24 in a condition at the start of a crowd operation, with the crowd cylinder 38 fully contracted. Further, the bellcrank adjusting cylinder pair 54 and the bucket control cylinder pair 62 are held at such lengths that the four corners 36, 60, 64 and 72 of the noted quadrilateral configuration are set in the illustrated relative positions. Thus the bucket 22 assumes a crowd attitude A, ready to start a level crowd operation.

The level crowd operation takes place as the crowd cylinder 38 is extended to cause the stick 34 to pivot in a clockwise direction about the pivot 36. Simultaneously the boom 26 is pivoted in a counterclockwise direction about the pivot 28 by the hoist cylinder pair 32 so as to permit the bucket 22 to take a level cut as it shifts forwardly to the broken-line position A′ in FIG. 1.

In the position A′ at the end of the level crowd operation the four corners 36, 60, 64 and 72 of the quadrilateral configuration gain the positions 36′, 60′, 64′ and 72′. The link pair 68 of the wrist linkage 66 is pivoted in a counterclockwise direction about the pivot 72 during the forward travel of the bucket 22. The result of this is a pivotal motion of the bucket 22 in a counterclockwise direction relative to the stick 34. However, since this counterclockwise turn of the bucket 22 proceeds in synchronism with the clockwise turn of the stick 34 relative to the boom 26, the bucket remains substantially level throughout its forward stroke. All that the operator is required to do during the level crowd operation, therefore, is to control the hoist cylinder pair 32 and the crowd cylinder 38 as above.

For converting the bucket 22 from the crowd attitude A into a carry attitude B during its forward stroke, the bellcrank adjusting cylinder pair 54 may be extended to cause the control bellcrank pair 48 to rotate about the pivot 50 in a clockwise direction through such an angle that the pivot 60 of the bucket control cylinder pair 62 thereon shifts to a position b. This pivot at b reaches a position b′ at the end of the forward stroke of the bucket 22, such that the bucket is rolled back into the carry attitude B. Thus the alteration from the crowd attitude A to the carry attitude B is achieved automatically during the forward bucket stroke, without the need for manipulating the bucket control cylinder pair 62.

The bucket 22 of the carry attitude B can then be raised past an intermediate position B′ to an elevated position B″ by extending the hoist cylinder pair 32 and so causing the boom 26 to pivot in a clockwise direction about the pivot 28. The carry attitude of the bucket 22 remains substantially unchanged throughout this upward stroke. The reason for this will be detailed later.

For conversion of the bucket 22 from the crowd attitude A into a dump attitude C during its forward stroke, the bellcrank adjusting cylinder pair 54 may be contracted to such an extent that the pivot 60 of the bucket control cylinder pair 62 on the control bellcrank pair 48 shifts to a position c. The pivot 60 at c assumes a position c' upon completion of the forward bucket stroke, causing the bucket 22 to roll forward into the dump attitude C.

The hoist cylinder pair 32 may therefore be extended to raise the bucket 22 simultaneously with its transformation from the crowd attitude A into the dump attitude C. Thus the load can be dumped at a desired height without manipulating the bucket control cylinder pair 62.

As has been pointed out, the four corners of the prior art parallelogram-type linkage are fixed or unadjustable. When the bucket is raised in the carry attitude, for example, the known parallelogram configuration causes the bucket to tilt back into the attitude shown and labeled "PRIOR ART ATTITUDE" in FIG. 1. Consequently the load may spill over the back of the bucket. No such spilling occurs in accordance with this invention because the bucket 22 retains its precise carry attitude in the elevated position B", for the following reason.

It will be recalled that the pivot 58 of the bellcrank adjusting cylinder pair 54 on the vehicle platform bucket 30 is offset forwardly from the pivot 28 of the boom 26 thereon. Let us consider the solid-line setting of the control bell crank pair 48 for the level crowd operation in FIG. 1. The pivot 60 of the bucket control cylinder pair 62 on the control bellcrank pair 48 follows the arcuate path 76 with the pivotal motion of the boom 26 about the pivot 28. The pivot or joint 36 between the boom 26 and the stick 34, on the other hand, follows the arcuate path 78.

The relative placement of the pivots 28 and 58 is such that the distance between the paths 76 and 78 is approximately constant in the lower portion of the stroke of the boom 26. The distance between the paths 76 and 78 gradually increases, however, as the boom 26 moves closer to its most elevated position. The noted quadrilateral configuration in accordance with this invention remains substantially unmodified as long as the paths 76 and 78 has the approximately constant distance therebetween. This fact explains why the bucket 22 can maintain the crowd attitude A in shifting forwardly to the position A' and also why the bucket attitude can be altered from A to the carry attitude B or to the dump attitude C.

With the upward motion of the boom 26 the bellcrank adjusting cylinder pair 54 acts to impart a gradual counterclockwise turn to the control bellcrank pair 48 about the pivot 50. The pivot 60 of the bucket control cylinder pair 62 on the control bellcrank pair 48 reaches a position 60" in the elevated position of the boom 26. If the pivot 60 has been shifted to the aforesaid positions b and c, then the pivot takes up positions b" and c", respectively, when the boom 26 is elevated.

All these elevated positions 60", b" and c" of the pivot 60 are rearward of the positions that would be occupied by the pivot 60 if the bellcrank adjusting cylinder pair 54 were pivoted on the vehicle at the same point as the boom 26. For this reason the bucket 22 retains the carry attitude when raised to the elevated position B", thereby preventing load spillage.

Second Form

Figure 2:
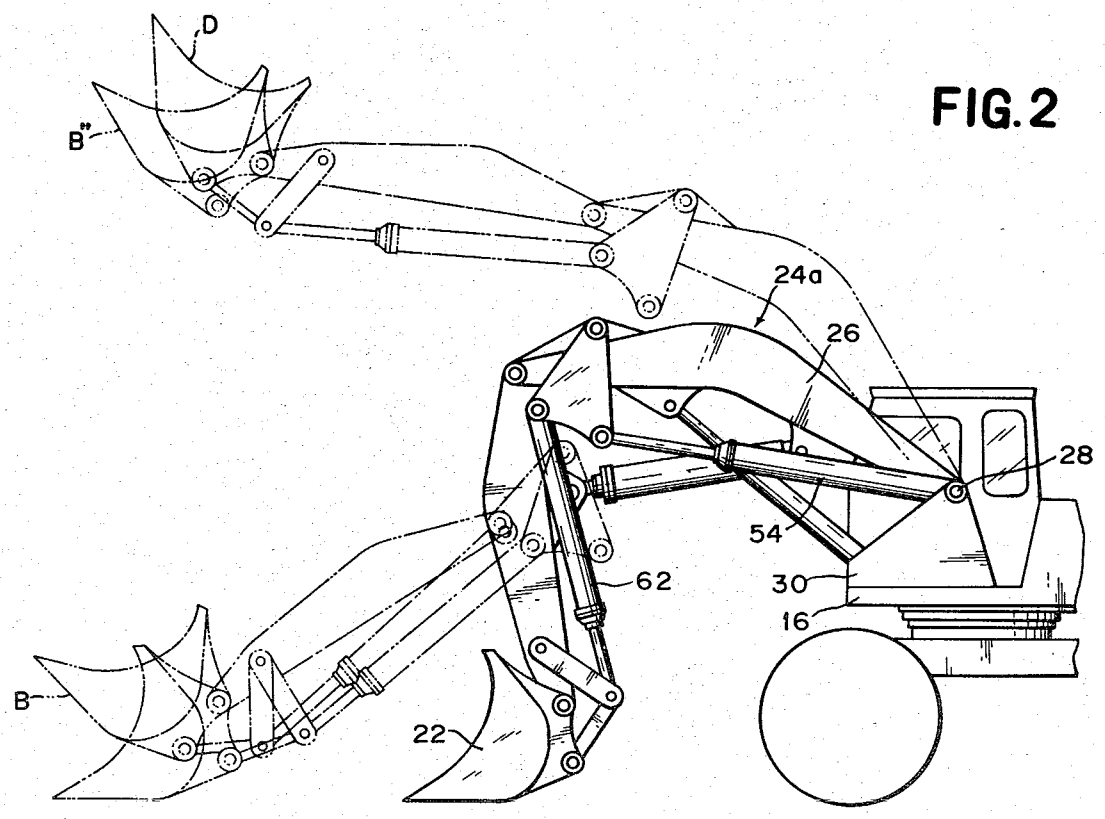
FIG. 2 is a view similar to FIG. 1 but showing an alternative embodiment of the invention.

FIG. 2 illustrates an alternative embodiment of this invention. This second embodiment differs from that of FIG. 1 only in that the bellcrank adjusting cylinder pair 54 is pivotally connected to the bracket 30 on the vehicle platform 16 at the same pivot 28 as the boom 26. Thus modified, the bucket actuating linkage of this excavator is generally designated 24*a*.

The operation of the modified excavator is also largely identical with that of the FIG. 1 excavator, with the bucket actuating linkage 24*a* permitting the bucket 22 to establish any selected one of the crowd, carry, and dump attitudes. The only difference arises when the bucket 22 is raised in the carry attitude B.

The bucket 22 will assume a rearwardly tilted attitude D in the elevated position if raised without manipulation of the bucket control cylinder pair 62. This is because the boom 26 and the bellcrank adjusting cylinder pair 54 are both pivoted at 28 on the vehicle platform bracket 30. In order to cause the bucket 22 to acquire the proper carry attitude B" in the elevated position, the bucket control cylinder pair 62 may be slightly contracted at the same time with the extension of the hoist cylinder pair 32.

Modifications

Figure 3:
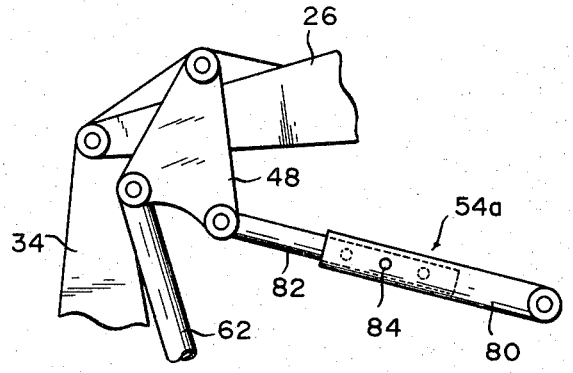
FIG. 3 is a fragmentary, side elevational view showing in particular modified means for adjustably varying the angular position of a pair of bucket attitude control bellcranks used in the embodiments of FIGS. 1 and 2.

FIG. 3 shows an alternative 54*a* to the bellcrank adjusting cylinder pair 54. The alternative bellcrank adjusting means 54*a* comprises, in place of each double-acting hydraulic cylinder, a sleeve 80 pivotally connected at one end to the platform bracket of the vehicle, and a rod 82 having one end portion slidably received in the sleeve 80 and pivotally connected at the other end to one of the control bellcranks 48. A lockpin 84 locks the sleeve 80 and the rod 82 at any of their three different combined lengths necessary for setting the control bellcrank pair 48 for the crowd, carry, and dump attitudes of the bucket 22.

Figure 4:
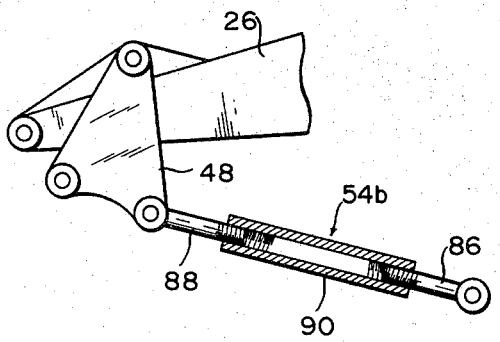
FIG. 4 is a fragmentary, side elevational view, partly sectioned for clarity, showing in particular another modification of the means for adjustably varying the angular position of the bucket attitude control bellcranks.

FIG. 4 gives another possible form 54*b* of the bellcrank adjusting means. This second modification 54*b* comprises a rod 86 pivotally connected at one end to the platform bracket of the vehicle, another rod 88 pivotally connected at one end to each control bellcrank 48, and a turnbuckle 90 screw-threadedly engaged with the other end portions of the rods 86 and 88. The control bellcrank pair 48 can be set in any of the three required angular positions about the pivot 50 by revolving the turnbuckle 90 relative to the rods 86 and 88.

While some embodiments of the invention have been shown and described herein, it will be understood that they are illustrative only and not to be taken as a definition of the scope of the invention, reference being had for this purpose to the appended claims.

What is claimed is:

1. A fluid-actuated excavator comprising:

(a) a vehicle having an undercarriage and a platform rotatably mounted on the undercarriage;

(b) a boom pivotally mounted at one end on the platform of the vehicle;

(c) a stick pivotally connected at one end to the other end of the boom;

(d) a fluid-actuated cylinder for pivotally operating each of the boom and the stick;

(e) a bucket pivotally connected to the other end of the stick;

(f) a bucket attitude control lever pivotally connected at one end of the boom;

(g) a fluid-actuated bucket control cylinder pivotally connected at one end to the other end of the bucket attitude control lever and at the other end to operate the bucket; and (h) means operatively connected between the vehicle platform and the bucket attitude control lever for adjustably varying the angular position of the bucket attitude control lever about said one end thereof;

(i) whereby a desired attitude of the bucket can be established by adjusting the angular position of the bucket attitude control lever about said one end thereof by the adjustably varying means.

2. A fluid actuated excavator according to claim 1, wherein the point of connection of the adjustably varying means to the vehicle platform is spaced forwardly from the point at which the boom is pivotally mounted on the vehicle platform.

3. A fluid actuated excavator according to claim 1, wherein the adjustably varying means is connected to the vehicle platform at the point where the boom is pivotally mounted thereon.

4. A fluid actuated excavator according to claim 1, wherein the adjustably varying means comprises at least one fluid-actuated, double-acting cylinder.

5. A fluid actuated excavator according to claim 1, wherein the adjustably varying means comprises:

(a) at least one sleeve pivotally connected at one end to either of the vehicle platform and the bucket attitude control lever;

(b) a rod pivotally connected at one end to the other of the vehicle platform and the bucket attitude control lever and having the other end portion received in the other end portion of the sleeve for movement into and away from same; and (c) means for locking the sleeve and the rod at a desired combined length thereof.

6. A fluid actuated excavator according to claim 1, wherein the adjustably varying means comprises:

(a) at least one turnbuckle; and (b) two aligned rods having their opposed end portions operatively engaged with the turnbuckle, each rod being pivotally connected at the other end to one of the vehicle platform and the bucket attitude control lever.

7. A bucket actuating and control linkage to be mounted on a self-propelled vehicle to provide a hydraulic excavator, comprising:

(a) a boom to be pivotally mounted at one end on the vehicle;

(b) a stick pivotally connected at one end to the other end of the boom;

(c) at least one hydraulic cylinder for pivotally operating each of the boom and the stick;

(d) a bucket pivotally mounted on the other end of the stick;

(e) a bucket attitude control lever pivotally connected at one end to the boom at said other end thereof;

(f) a hydraulic bucket control cylinder pivotally connected at one end to the other end of the bucket attitude control lever and at the other end to operate the bucket; and (g) means for adjustably varying the angular position of the bucket attitude control lever about said one end thereof;

(h) whereby the bucket can be conditioned for a desired one or two successive different ones of several different operating attitudes by adjusting the angular position of the bucket attitude control lever about said one end thereof by the adjustably varying means.

8. An apparatus according to claims 1 or 7, wherein the bucket attitude control lever is in the form of a bellcrank having a first apex pivotally connected to the boom, a second apex pivotally connected to the bucket control cylinder, and a third apex operatively connected to the adjustably varying means.

9. An apparatus according to claims 1 or 7, wherein the bucket is of the front loading type.

* * * * *